US011304518B1

(12) United States Patent
Emery

(10) Patent No.: US 11,304,518 B1
(45) Date of Patent: Apr. 19, 2022

(54) TABLE STABILIZATION SYSTEM AND METHOD OF USE

(71) Applicant: Hyla Emery, Arlington, TX (US)

(72) Inventor: Hyla Emery, Arlington, TX (US)

( * ) Notice: Subject to any disclaimer, the term of this patent is extended or adjusted under 35 U.S.C. 154(b) by 0 days.

(21) Appl. No.: 16/796,271

(22) Filed: Feb. 20, 2020

Related U.S. Application Data

(60) Provisional application No. 62/807,998, filed on Feb. 20, 2020.

(51) Int. Cl.
*A47B 87/00* (2006.01)

(52) U.S. Cl.
CPC ..... *A47B 87/002* (2013.01)

(58) Field of Classification Search
CPC .... A47B 87/002; A47B 87/007; A47B 87/008
USPC ..... 108/64, 65, 69, 67, 54.1, 27, 159.11, 108/158.13, 157.18, 157.1
See application file for complete search history.

(56) References Cited

U.S. PATENT DOCUMENTS 1,040,270 A * 10/1912 Bryning ..... A47B 87/002 108/64
D142,211 S * 8/1945 Glukes ..... D6/691
2,628,141 A * 2/1953 Scheuer ..... A47F 5/0043 108/157.13
2,737,430 A * 3/1956 Ess ..... A47B 13/08 108/64
2,752,215 A * 6/1956 Peiss ..... A47B 87/008 312/111
2,790,691 A * 4/1957 Goebel ..... A47B 87/008 312/111
2,940,805 A * 6/1960 Nordmark ..... A47B 13/083 108/27
3,049,388 A * 8/1962 Browne ..... A47B 13/08 108/157.18
3,091,487 A * 5/1963 Gallagher ..... F16B 2/245 403/381
D277,934 S * 3/1985 Beckrot ..... D8/382
4,799,727 A * 1/1989 Robbins ..... B60J 1/1823 16/225
5,144,888 A * 9/1992 Heine ..... A47B 87/002 108/64
5,729,867 A * 3/1998 Carmichael ..... E04B 2/7429 16/225
6,116,162 A * 9/2000 Santa Cruz ..... A47B 13/083 108/27
6,485,219 B1 * 11/2002 Beyer ..... A47B 87/008 403/338
7,322,299 B2 * 1/2008 Greene ..... B65D 19/0069 108/51.3
7,704,170 B2 * 4/2010 Julian ..... A47B 87/002 473/496
7,806,474 B2 * 10/2010 Wahl ..... A47C 13/005 297/248
8,146,517 B1 * 4/2012 Masser ..... E04F 15/105 108/156

(Continued)

*Primary Examiner* — Jose V Chen
(74) *Attorney, Agent, or Firm* — Leavitt Eldredge Law Firm

(57) ABSTRACT

A table stabilization system allows multiple tables to be quickly and efficiently joined together by a single or multiple bonding devices. The bonding device slides over the joint between two tables and holds the stationary. The bonding device also provides a planer surface on which objects can be placed without tipping or falling over.

3 Claims, 5 Drawing Sheets

(56) References Cited

U.S. PATENT DOCUMENTS

| | | | | |
|---|---|---|---|---|
| 9,161,623 | B1 * | 10/2015 | Lin | A47B 87/002 |
| 9,488,204 | B2 * | 11/2016 | King | A47B 87/002 |
| 2010/0196088 | A1 * | 8/2010 | Johnsson | A47C 4/02<br>403/291 |
| 2015/0059622 | A1 * | 3/2015 | Quinones | A47B 97/00<br>108/27 |

* cited by examiner

TABLE STABILIZATION SYSTEM AND METHOD OF USE

BACKGROUND

1. Field of the Invention

The present invention relates generally to table arrangement systems, and more specifically, to a table stabilization system for joining tables in such a manner as to prevent movement of one table with respect to the second.

2. Description of Related Art

Table arrangement systems are well known in the art and are effective means to allow for more than one table to be used together as a single table. For example, FIG. 1 depicts a conventional arrangement of multiple tables 101 to act as one larger table having two tables 103 pushed up next to each other so that the edges of the tables 103 are next to each other. During use, the tables 103 and their top surfaces 105 have a mismatch 107 between them, this can cause dishes or other objects placed at 107 to fall over or sit in a conspicuous manner.

One of the problems commonly associated with arrangement 101 is its limited efficiency. For example, the aforementioned mismatch and the resulting potential risk of spilling from dishes placed across the tops of two tables 103.

Additionally, the mismatch of the tables 103 creates hazards for those sitting or standing nearby as the tables may appear stable when they are not. When the tables 103 are not stable such as when weight is placed near an unsupported edge.

Accordingly, although great strides have been made in the area of multiple table arrangements, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
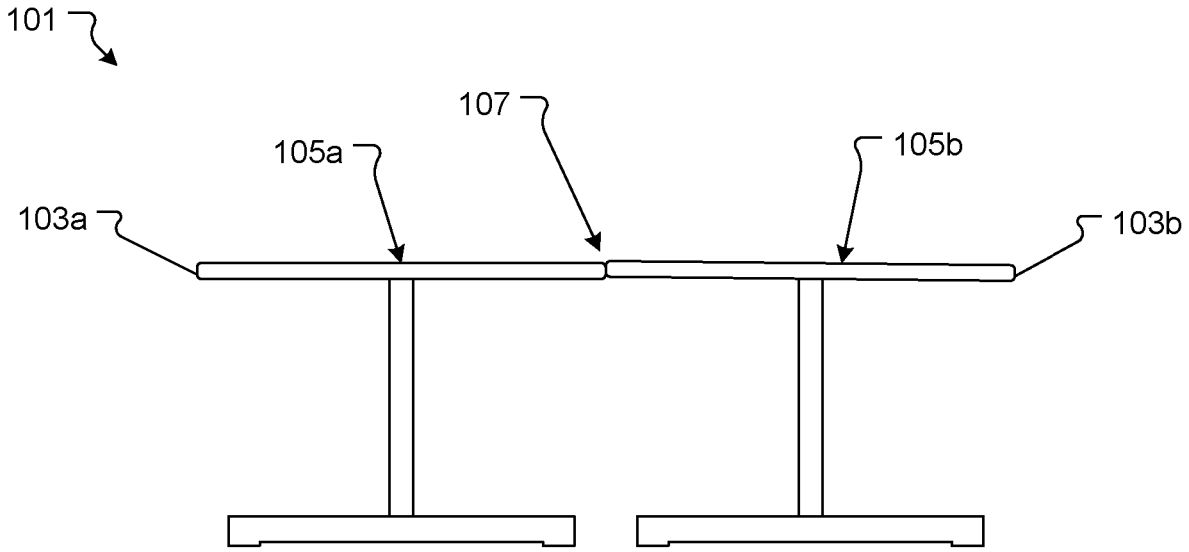
FIG. 1 Prior Art
FIG. 1 is a front view of a common multiple table arrangement.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional multiple table arrangements. Specifically, the invention of the present application creates a joint between two tables to ensure that the tops thereof are aligned. In addition, the joint between the tables is strengthened allowing more weight to be placed near the edges without risk of tipping. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
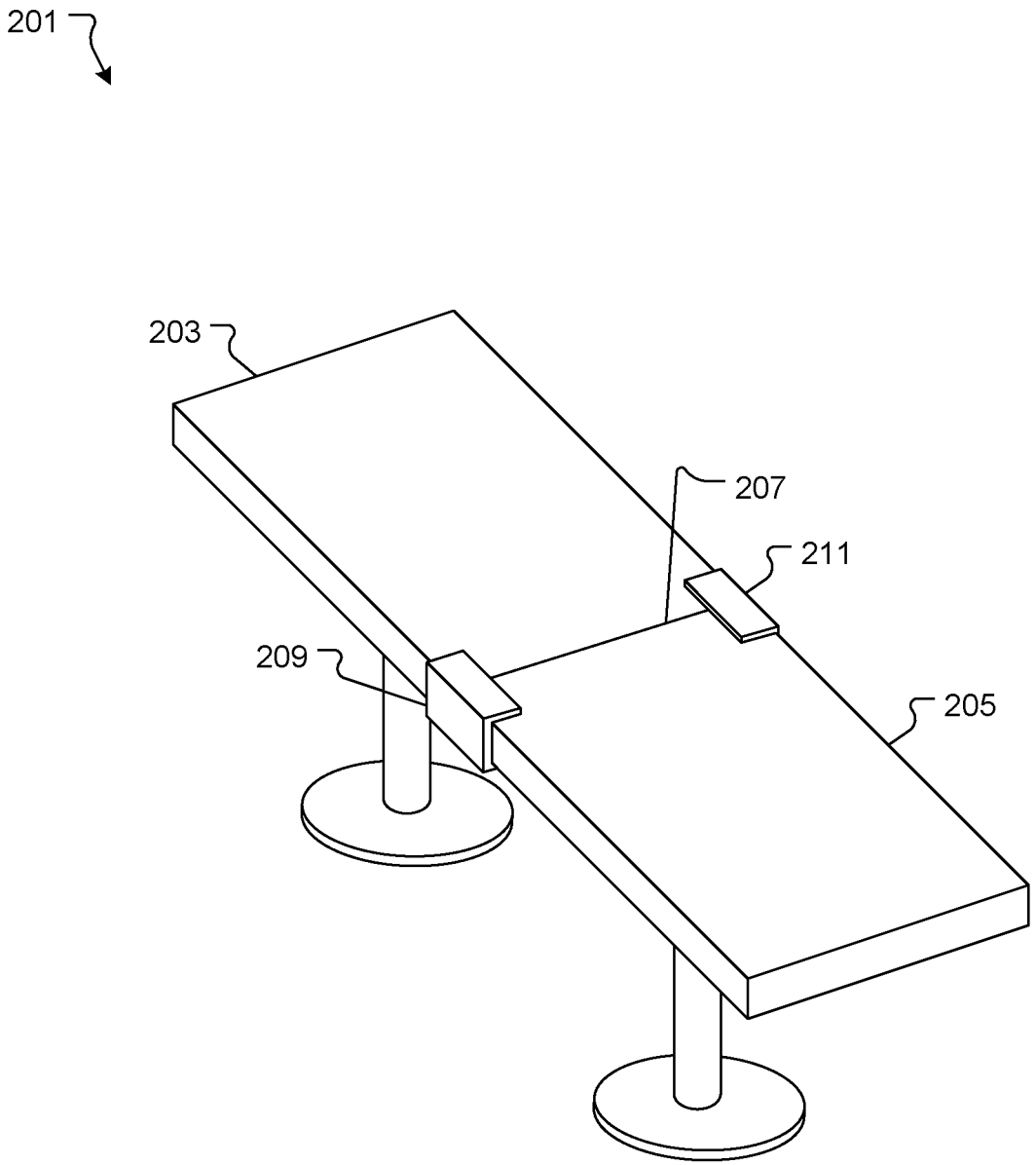
FIG. 2 is a perspective view of a table stabilization system in accordance with a preferred embodiment of the present application.

Referring now to the drawings wherein like reference characters identify corresponding or similar elements throughout the several views, FIG. 2 depicts a perspective view of a table stabilization system in accordance with a preferred embodiment of the present application. It will be appreciated that system 201 overcomes one or more of the above-listed problems commonly associated with conventional multiple table arrangements.

In the contemplated embodiment, system 201 includes a first table 203 and a second table 205 with a joint line 207 including at least one edge of each. The first table 203 and second table 205 are secured together via a first bonding device 209 and a second bonding device 211. Each bonding device 209, 211 grips part of the first table 203 and the second table 205.

In use, any number of tables are joined together where any table is the first table 203 or second table 205. The bonding devices allow the tables to function as one and prevent any mismatch from presenting itself along the joint line 207.

Figure 3:
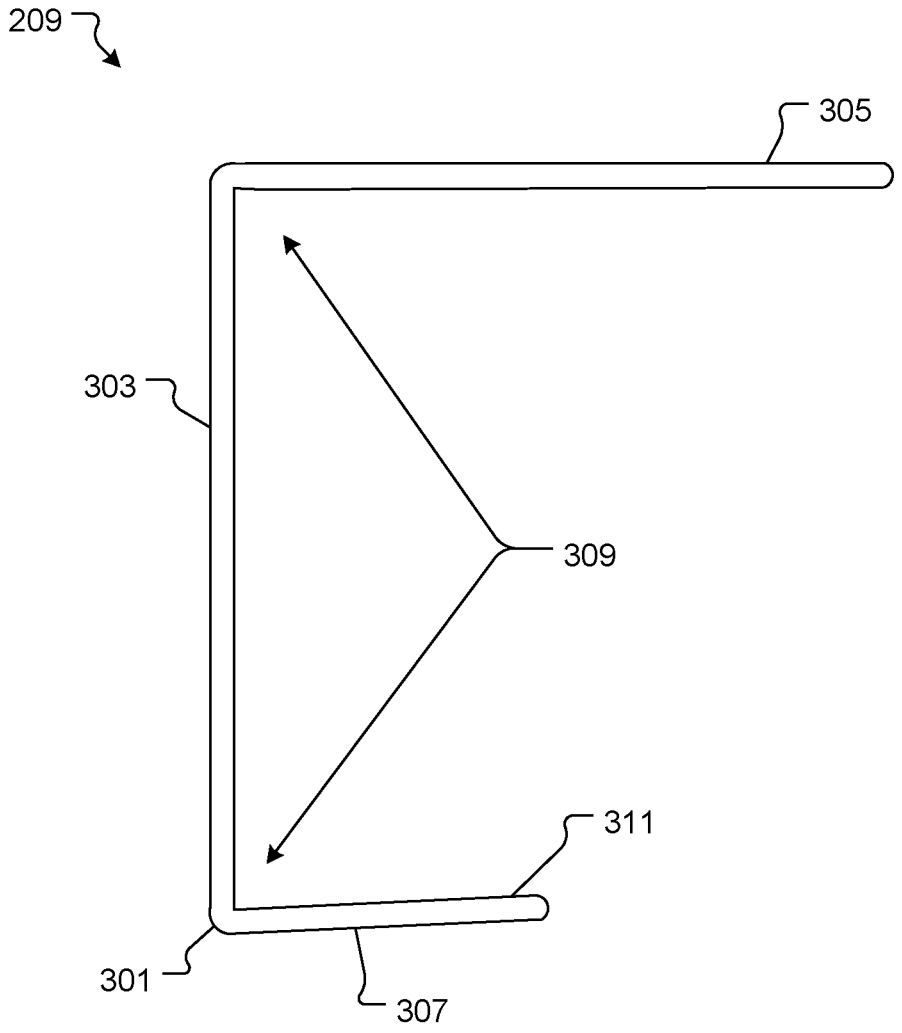
FIG. 3 is a side view of the bonding device of FIG. 2.

The bonding device 209 is depicted in FIG. 3 and includes a body 301 with a spine 303 with a first leg 305 extending out and away therefrom at a first end and a second leg 307 also extending out and away therefrom to form a U shape or channel therebetween. The angle 309 of the legs with respect to the spine 303 is contemplated to be right or acute so as to allow the legs to apply pressure or force to the table tops. It is further contemplated that the interior surface 311 of the bonding device 209 could be coated or have a surface finish that would increase the friction between the table top to ensure that the device 209 remains attached to the tables while in use.

It should be appreciated that one of the unique features believed characteristic of the present application is that the bonding device 209 joins the first table 203 to the second table 205 and bridges any gap therebetween.

It will be appreciated that the bonding device 209 does not damage or penetrate either of the tables 303, 305. It will be further appreciated that no special physical requirements or adaptations to use the system 201 allowing the bonding device 209 to be used with any existing table.

Figure 4:
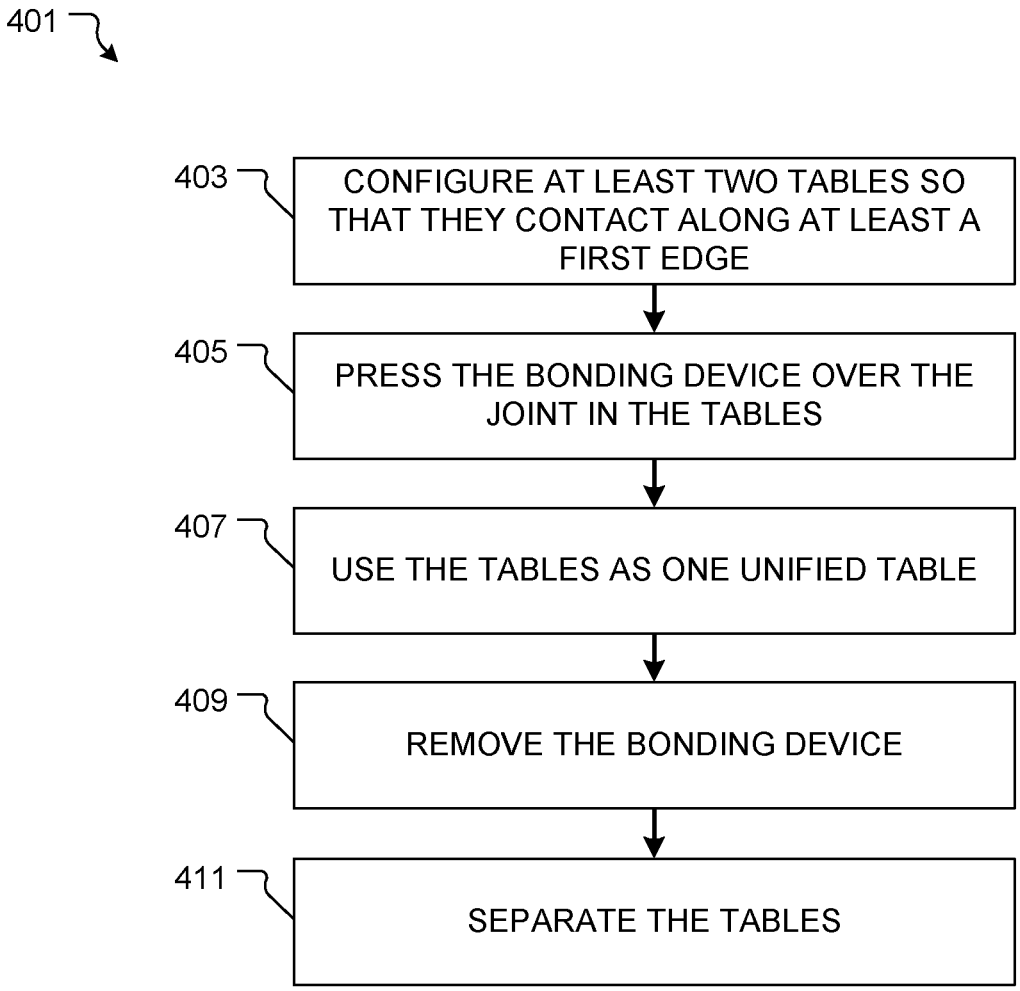
FIG. 4 is a flowchart of a method of joining multiple tables.

Referring now to FIG. 4 a method of joining multiple tables to act as one is depicted. Method 401 includes configuring at least two tables so that they contact along at least a first edge 403, pressing the bonding device over the joint line of the tables 405, using the tables as one unified table 407, removing the bonding device 409 and separating the tables 411 for use individually.

Figure 5:
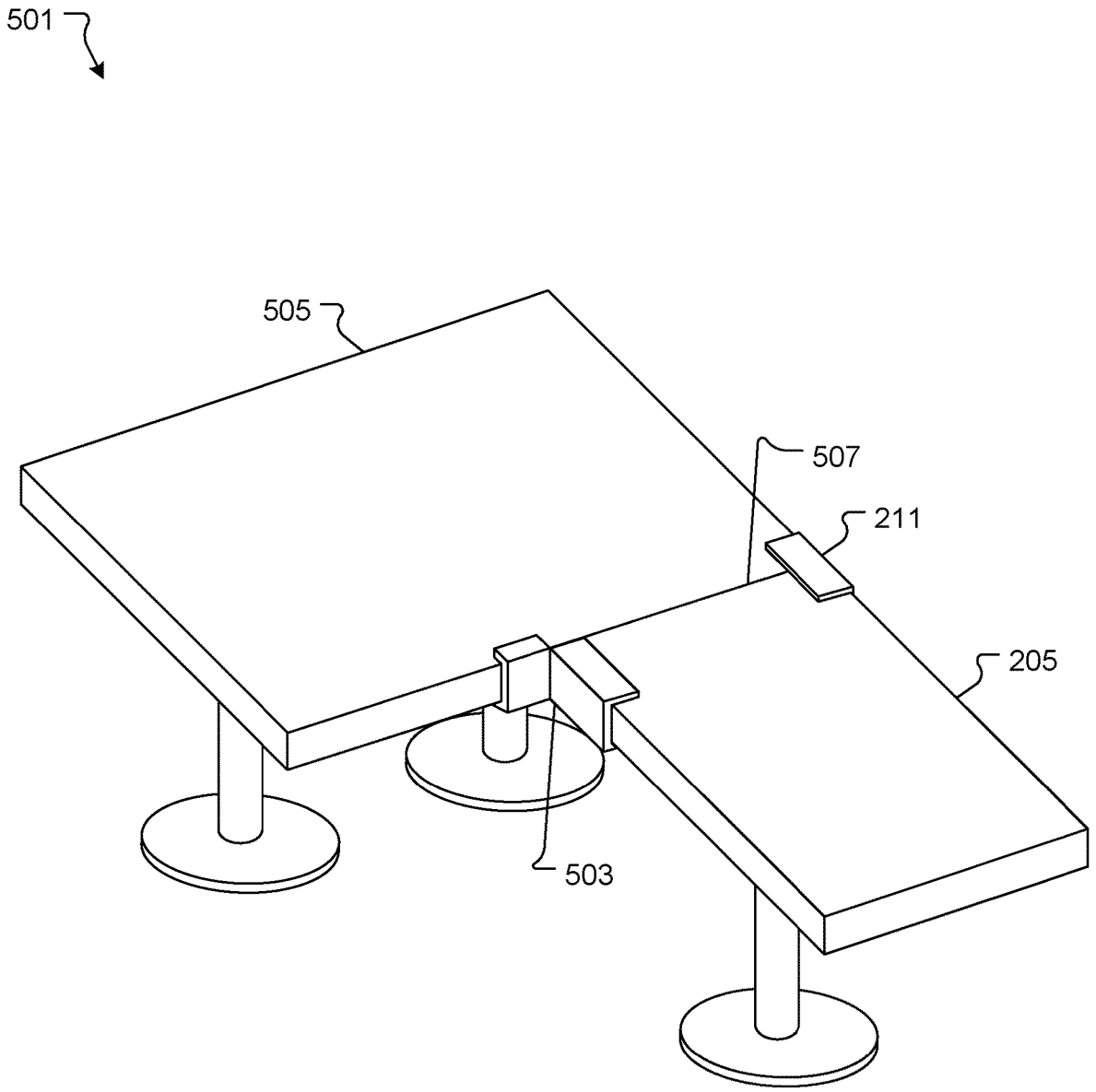
FIG. 5 is a perspective view of an alternative embodiment of the system of FIG. 2.

An alternative embodiment of the system 201 is depicted by FIG. 5 including similar elements as system 201 wherein the first table is larger than the second table 205 and that the joint line 507 only includes a portion of an edge of the first table 505. A bonding device 503 is contemplated that attaches to the first table 505 and the second table 205 in a nonlinear fashion. As contemplated the spine of the bonding device is non-planer.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A table stabilization system for joining two tables, the system comprising:

a bonding device having:

a spine;

a first leg and a second leg, both the first leg and the second leg are integral with and attached to the spine and configured to extend out and away therefrom the spine, the first leg has a greater length that a length of the second leg;

the spine extending straight between the first leg and the second leg and having an interior straight surface;

the first leg and the second leg being straight and lacking curves or angles;

the first leg extending away from the spine at a 90 degree angle relative to the interior straight surface; and the second leg extending away from the spine at an angle less than 90 degrees relative to the interior straight surface;

wherein the two tables are secured in position via the bonding device such that the interior straight surface of the spine rests against each of the two tables; and wherein the first leg comes into contact with a table top of one of the two tables such that an entire length of the first leg touches the table top when in use.

2. The system of claim 1 wherein the spine is non-planer.

3. The method of joining multiple tables together to act as one, comprising:

providing the system of claim 1;

configuring the two tables so that they contact along at least a first edge;

pressing the bonding device over the joint line of the two tables, wherein that the first leg comes into contact with the table top such that the entire length of the first leg touches the table top;

using the tables as one unified table;

removing the bonding device; and separating the tables.

* * * * *